United States Patent [19]

Ghiringhelli et al.

[11] 4,128,462

[45] Dec. 5, 1978

[54] ELECTROCHEMICAL PROCESS FOR RECOVERING PRECIOUS METALS FROM THEIR ORES

[76] Inventors: Hugh A. Ghiringhelli, 436 Danbury Rd., Wilton, Conn. 06897; Kenneth S. Deffeyes, 40 Western Way, Princeton, N.J. 08540

[21] Appl. No.: 714,828

[22] Filed: Aug. 16, 1976

[51] Int. Cl.[2] ..... C25C 1/20

[52] U.S. Cl. ..... 204/109

[58] Field of Search ..... 204/109, 46 G, 46 R

[56] References Cited

U.S. PATENT DOCUMENTS

| | | | |
|---|---|---|---|
| 2,384,300 | 9/1945 | Harford | 204/46 R |
| 2,729,557 | 1/1956 | Booth et al. | 204/46 R |

*Primary Examiner*—R. L. Andrews

*Attorney, Agent, or Firm*—Joseph L. Lazaroff; Alphonse R. Noe

[57] ABSTRACT

An electrochemical process of the type for recovering precious metals such as gold and silver from their ores by adding to a slurry of the ore a cyanide complexing agent such as sodium cyanide and by electrolytically recovering the precious metal. The process is characterized by the use of small quantities, e.g., 50 milligrams per liter, of a water soluble electroconductive cationic resin, preferably polyvinylbenzyltri-methylammonium-chloride sold under the name ECR-34 by Dow Chemical Company of Midland, Michigan as an aqueous solution containing 33.7% of solids. The use of such a resin increases the amount of precious metals recovered from the ore per unit of time, improves the degree of recoverability, and improves the quality of the recovered metal.

5 Claims, No Drawings

ELECTROCHEMICAL PROCESS FOR RECOVERING PRECIOUS METALS FROM THEIR ORES

BACKGROUND OF THE INVENTION

1. Field of the Invention

This invention relates to an electrochemical process for the recovery of precious metals, particularly silver and gold, from ores, including not only newly mined material but also tailings, slags and dumps remaining from previous recovery or mining operations. More specifically, the present invention relates to improvements upon processes for electrolytic recovery of precious metals from ores by means of cyanide complexing agents.

2. Description of the Prior Art

A variety of processes have been developed for electrochemically treating ores for the purpose of recovering their precious metals, particularly silver and gold. Many processes, as exemplified by U.S. Pat. No. 601,068 to Von Siemans, use cyanidation treatments. Notwithstanding considerable efforts devoted to the development of various electrochemical processes for recovering precious metals, none have been capable of a level of performance which makes them commercially practical for processing low grade new ores, or for reprocessing the vast quantity of low grade precious metal-containing tailings, slags and dumps which are the remnants of previous mining operations. The major drawbacks of prior electrochemical recovery techniques is that they are slow, and have difficulty in extracting precious metals from low grade ores. Extraction of precious metals during conventional cyanidation typically takes 3 to 24 hours, necessitating a massive apparatus if worthwhile amounts of precious metals are to be obtained from low grade ores. For these and other reasons, electrochemical techniques for recovering precious metals from ores have not been commercially practical or successful.

SUMMARY OF THE INVENTION

A principal object of the present invention is to provide an improved electrochemical process for recovery of precious metals from ores. Specific objects of the invention are to provide such a process which is capable of more rapid recovery of precious metals, which is capable of extraction of precious metals from low grade ores, and which may be economically performed without the need for large or complicated devices or exotic or costly additives. Still another object of the invention is to provide such a process and apparatus which are suitable for use in commercial recovery of precious metals from low grade ores now considered to be too uneconomical to process.

We have discovered that the recovery of precious metals from ores using cyanide complexing agents and electrolytic precipitation of the precious metal-cyanide complexes can be improved markedly by the addition of small amounts of a water soluble electroconductive polymeric resin of the cationic type. The addition of such a resin markedly increases the amount of metal deposited per unit time during the process and also improves the selectivity of the process to precious metals and the purity of the deposited metal. In a preferred embodiment of the invention to be described hereinbelow in detail, the resin is polyvinylbenzyl-tri-methylammoniumchloride sold as an aqueous solution containing 33.7% solids under the name ECR-34 by Dow Chemical Company of Midland, Michigan. Such resins are polymeric materials having pendant ionizable chemical moieties, and electrical conductivity is brought about through ionic rather than electronic means. Typical applications for these resins heretofore have been as paper coatings especially in electrophotographic copying and dielectric printing.

Other objects, aspects and advantages of invention will be pointed out in, or apparent from, the detailed description hereinbelow.

DESCRIPTION OF THE PREFERRED EMBODIMENT

Recovery of precious metals from their ores is accomplished by preparing an aqueous slurry of the ground ore. As an example, the ore grains may have a size of, minus 60 mesh, and the slurry may be about 25% solids by weight. To the aqueous ore slurry is added a quantity of cyanide complexing agent, such as sodium cyanide, to form a dilute solution. Concentrations of, e.g., 2 grams of dry sodium cyanide per kilogram of dry ore are typical. The alkalinity of the slurry may be increased by adding a material such as dry sodium hydroxide to bring the alkalinity to at least about 0.01 equivalents/liter to improve dissolution but lower alkalinities also may be used. A small quantity of a water soluble electroconductive cationic resin, preferably the aforementioned product ECR-34, which is an aqueous solution of 33.7% solids of polyvinylbenzyltrimethylammoniumchloride, is added to the slurry. Small quantities of the resin appear to be sufficient to obtain much improved results. For example, the addition of as little as 50 milligrams of resin solids per kilogram of dry ore is sufficient to provide about a 60% improvement in metal extraction. The optimum amount for a particular ore may be determined experimentally.

After the foregoing materials are admixed, the ore slurry then is acted upon electrolytically, preferably in accordance with the processes disclosed in our copending application Ser. No. 714,827, filed Aug. 16, 1976, incorporated herein by reference. Briefly, in accordance with the process described in our copending application, the ore slurry is put into direct contact with anodic and cathodic electrodes which are closely spaced, e.g., 1 centimeter or less apart, and have a large surfact area. A low voltage impressed across the electrodes provides a current density of about 10–20 amperes per square meter, and the ore slurry is agitated sufficiently to provide eddy diffusion of ore grains in the slurry to facilitate transport of the ore grains into electrical contact with the electrodes. Recovery of the precious metal occurs at the cathode by electrolytic precipitation of the precious metal-cyanide complex, freeing the complexing agent for further dissolution of precious metal in the ore.

The addition of the water soluble electroconductive cationic resin improves both the rate of recovery of the process and the degree of extractability of the precious metal from the ore. The exact chemical mechanism by which the resin brings about this improvement is not known, but it is believed that the resin functions in part as a water soluble ion exchanger. For our purposes, the precious metal complexes most commonly transported in solution are the gold and silver cyanide ions $Au(CN)^-$ and $Ag(CN)^-$. Both are anions and the electrically induced transport in the cell tends to carry these anions away from the cathodes. Yet it is at the cathode that the precious metal is recovered as a valuable deposit. It is believed that association of the gold and silver complexes with a soluble and mobile species, which itself has a large positive charge, can reduce or perhaps even reverse the antipathy which the negatively charged precious metal cyanide complexes have for the cathodes, thereby creating a situation in the electrolytic cell whereby more precious metals may be deposited at minimum currents. Minimum currents avoid competing reactions such as the liberation of hydrogen.

Electrochemical deposition processes are complex and involve many factors which can have a considerable effect upon the rate and quality of metal deposition. The processes and limitations are broadly described in many textbooks which have been written on this subject. Among the most commonly referred to limitations are those occurring due to polarization, mass transport, convection, concentration and diffusion. It appears that the present invention allows theoretical rates of deposition to be closely approached, and while the exact mechanism or nature by which the resin produces such beneficial results is not known to the inventors, it is assumed the cationic nature of the resin in some way alters the normally limiting modes encountered in the usual electroplating processes for precious metals. Such altering effects may act on one or more of the limiting mechanisms.

In practice we have found that as little as 50 milligrams of electroconductive resin in a liter of electrolyte-ore slurry increased the recovery of silver in a given time by over 60%. In the same experimental comparison the silver to copper ratio in the deposited metal was twice as large when the resin was present as compared to the deposit produced in the absence of the resin. The experimental ore for this comparison was tailings from a silver mining operation and the electrolyte was dry sodium cyanide at a rate of 5 pounds per ton of ore and potassium carbonate at the rate of 5 pounds per ton of ore. The only difference between the two runs was the addition of 50 milligrams of the conductive resin per liter of ore-electrolyte slurry. No limitations on process performance have been found to be due to changes in electrolyte compositions and the resin seems to operate equally well in an electrolyte composed of hydroxides or other pH adjusting alkaline salt electrolytes. We have found little difference based on using an excessive amount of resin in comparison to the amount of cyanide used and believe therefore that the activity of the resin is related to its adsorption of the cyanide complex.

EXAMPLES

The following specific example is illustrative of the practice of the invention. One kilogram of tailings from a Nevada silver mill, left from a pre-1890 recovery process, was analyzed by x-ray fluorescence (accurate to ±20%) was found to contain about 20 oz. of silver per ton. Sufficient tap water was added to the tailings to form a slurry with a volume of 1000 c.c. Admixed with the slurry were: 2 grams of sodium hydroxide (dry), 2 grams of sodium cyanide (dry), and 0.15 c.c. of a 33.7% solids solution of the electroconductive resin ECR-34 manufactured by the Dow Chemical Company. The slurry was then placed in an apparatus similar to apparatus 20 of FIG. 2 in our previously referred to copending application Ser. No. 714,827, containing 7 vertical plates of 304 stainless steel, 3 plates serving as cathodes with a total surface area of 1200 square centimeters, and 4 plates serving as anodes with a total surface area of 1600 sq. cm. The electrodes were spaced 0.3 cm. apart, and a voltage of 2.7 volts d.c. was impressed between each anode and cathode. A current of 2 amperes d.c. was drawn. The slurry was recirculated at room temperature (e.g. 25° C.) past the electrodes by means of an air lift formed with a miniature air pump connected to the container with tubing.

Samples of the slurry were withdrawn after 2, 4, 8 and 16 minutes, and analyzed by x-ray fluorescence. After 2 minutes, the slurry contained about 11 oz. of silver per ton; after 4 minutes, 9.5 oz.; and after 8 and 16 minutes, less than 5 oz. per ton. In other words, the apparatus and process recovered about 9 oz./ton in 2 minutes; 10.5 oz./ton in 4 minutes; and 15 oz./ton in 8 minutes. This rapid recovery rate allows a small apparatus, which can be relatively mobile, to process large quantities of ore and obtain commercially valuable amounts of precious metal.

In a second illustrative example, gold-bearing telluride ore with a gold content, determined by fire assay, of 7.92 oz./ton was formed into a slurry by grinding 100 grams to −200 mesh and mixing with 200 grams of water. Sodium hydroxide was added to bring the alkalinity to about 0.15 equivalents/liter. Dry sodium cyanide was added at the rate of about 1.6 grams/kg of dry ore. The resin ECR-34 described above was added in the same concentration as the previous example. The slurry was placed in a stainless steel cup 15 centimeters in diameter, connected as an anode, a single copper cathode was inserted, and a current of about 250 milliamperes was drawn. Agitation of the slurry was accomplished by mechanical stirring. Deposition of gold proceeded on the cathode. After 8 minutes the ore was drained and filtered, and determined by fire assay to have a remaining gold content of 0.88 oz./ton.

Although a specific embodiment of the invention has been disclosed herein in detail, it is to be understood that this is for the purpose of illustrating the invention, and should not be construed as necessarily limiting the invention, since it is apparent that many changes can be made to the disclosed structures by those skilled in the art to suit particular applications.

We claim:

1. In an electrochemical process for recovery of precious metals from their ores by supplying a slurry of the ore with a cyanide complexing agent for the precious metal and electrolytically processing the slurry to dissolve the precious metal from the slurry and recover the metal by electrodeposition at a cathode, the improvement which comprises adding to the slurry the water soluble electroconductive cationic resin polybenzyltrimethylammoniumchloride, whereby the recovery of precious metals is improved.

2. An electrochemical process as claimed in claim 1 wherein the resin is added at a rate of at least about 50 milligrams per kilogram of dry ore.

3. An electrochemical process as claimed in claim 1 further comprising recovering the precious metal at a cathodic electrode.

4. An electrochemical process as claimed in claim 3 further comprising continuously flowing the slurry past the cathodic electrode.

5. An electrochemical process as claimed in claim 1 further comprising maintaining the alkalinity of the slurry at at least about 0.01 equivalents/liter.

* * * * *